US005241356A

United States Patent [19]

Bray et al.

[11] Patent Number: 5,241,356

[45] Date of Patent: Aug. 31, 1993

[54] METHOD AND APPARATUS FOR MINIMIZING THE VOLTAGE DIFFERENCE BETWEEN A DEVELOPED ELECTROSTATIC IMAGE AREA AND A LATENT ELECTROSTAIC NON-DEVELOPED IMAGE

[75] Inventors: Daniel M. Bray; Jeffrey J. Folkins, both of Rochester; Thomas J. Behe, Webster, all of N.Y.

[73] Assignee: Xerox Corporation, Stamford, Conn.

[21] Appl. No.: 922,585

[22] Filed: Jul. 29, 1992

[51] Int. Cl.[5] ..... G03G 15/01

[52] U.S. Cl. ..... 355/328; 355/326; 430/42

[58] Field of Search ..... 355/202, 200, 266, 210, 355/219, 326, 327, 77, 221, 328; 430/19, 32, 42

[56] References Cited

U.S. PATENT DOCUMENTS

| | | | |
|---|---|---|---|
| 4,033,668 | 7/1977 | Presby | 350/96 C |
| 4,660,059 | 4/1987 | O'Brien | 346/157 |
| 4,660,961 | 4/1987 | Kuramoto et al. | 355/202 |
| 4,761,669 | 8/1988 | Langdon | 355/326 |
| 4,791,452 | 12/1988 | Kasai et al. | 355/326 |
| 4,819,028 | 4/1989 | Abe | 355/326 X |
| 4,833,503 | 5/1989 | Snelling | 355/259 |
| 4,868,611 | 9/1989 | Germain | 355/328 |
| 4,959,286 | 9/1990 | Tabb | 355/326 X |
| 4,959,695 | 9/1990 | Nishimura et al. | 355/327 |
| 4,984,021 | 1/1991 | Williams | 355/328 X |
| 5,049,949 | 9/1991 | Parker et al. | 355/328 X |

*Primary Examiner*—A. T. Grimley
*Assistant Examiner*—Sandra L. Brasé

[57] ABSTRACT

In a multi-color imaging apparatus, the voltage differential between developed and undeveloped areas of a charge retentive surface is reduced for precluding edge effect development. The developed areas correspond to charged areas on the photoreceptor while the undeveloped areas represent discharged or background areas on the photoreceptor. Development of the charged areas is followed by an erase step for reducing the voltage differential between the developed areas and the non-developed background areas prior to the next development step.

8 Claims, 4 Drawing Sheets

METHOD AND APPARATUS FOR MINIMIZING THE VOLTAGE DIFFERENCE BETWEEN A DEVELOPED ELECTROSTATIC IMAGE AREA AND A LATENT ELECTROSTAIC NON-DEVELOPED IMAGE

BACKGROUND OF THE INVENTION

This invention relates generally to color imaging and more particularly to the use of plural exposure and development steps for such purposes.

It is common practice to add information to the face of a document or to highlight certain portions of it by underlining. It is also common to delete portions of the document either by crossing out information or by covering it with a blank piece of paper. As will be appreciated, writing data or underlining on the document spoils the original document while writing data or underlining on the copies requires much labor when many copies are required. Moreover, it is sometimes difficult to write on copies due to the impregnation of the paper substrate with silicone oil used in the fusing of xerographic images to the substrate.

Recent developments in imaging systems have obviated the foregoing problems by the provision of methods and apparatus to reproduce altered copies of an original document. This, recent innovations in printing machines provide for reproducing portions of a document in one color and other portions thereof in a different color.

One method of printing in different colors is to uniformly charge a charge retentive surface and then optically expose the surface to information to be reproduced in one color. This information is rendered visible using marking particles followed by the recharging of the charge retentive prior to a second exposure and development.

U.S. Pat. No. 4,791,452 relates to two-color imaging apparatus wherein a first latent image is formed on a uniformly charged, charge retentive surface and developed with toner particles. The charge retentive surface containing a first developed or toned image and undeveloped or untoned background areas is then recharged prior to optically exposing the surface to form a second latent electrostatic image thereon. The recharging step is intended to provide a uniformly charged imaging surface prior to effecting a second exposure.

U.S. Pat. No. 4,819,028 discloses an electrophotographic recording apparatus capable of forming a clear multicolor image including a first visible image of a first color and a second visible image of a second color on a photoconductive drum. The electrophotographic recording apparatus is provided with a conventional charger unit and a second charger unit for charging the surface of the photoconductive drum after the first visible image is formed thereon so as to increase the surface potential of the photoconductive drum to prevent the first visible image from being mixed with a second color and scratched off from the surface of the photoconductive drum by a second developing unit.

U.S. Pat. No. 4,660,961 discloses a copying apparatus of the electrostatic type which enables two images to be synthesized on one surface of a copying paper using original positive image sources without preparing negative images sources prior to the copying process. The copying apparatus can also synthesize a plurality of images in different colors on a single sheet of paper.

U.S. Pat. No. 4,761,669 relates to creating two-color images. A first image is formed using the conventional xerographic process. Thus, a charge retentive surface is uniformly charged followed by light exposure to form a latent electrostatic image on the surface. The latent image is then developed. A corona generator device is utilized to erase the latent electrostatic image and increase the net charge of the first developed image to tack it to the surface electrostatically. This patent proposes the use of an erase lamp, if necessary, to help neutralize the first electrostatic image. A second electrostatic image is created using an ion projection device. The ion image is developed using a second developer of a different color.

U.S. Pat. No. 4,033,688 discloses a color copying apparatus which utilizes a light-lens scanning device for creating plural color images. This patent discloses multiple charge/expose/develop steps.

U.S. Pat. No. 4,833,503 discloses a multi-color printer wherein a recharging step is employed following the development of a first image. This recharging step, according to the patent is used to enhance uniformity of the photoreceptor potential, i.e. neutralize the potential of the previous image.

U.S. Pat. No. 4,660,059 discloses an ionographic printer. A first ion imaging device forms a first image on the charge retentive surface which is developed using toner particles. The charge pattern forming the developed image is neutralized prior to the formation of a second ion image.

U.S. patent application Ser. No. 856,311 filed on Mar. 23, 1992 and assigned to the same assignee as the instant application discloses a printing system wherein charged area images and discharged area images are created, the former being formed first and the latter being proceeded by a recharging of the imaging surface.

A number of commercial printers employ the charge/expose/develop/recharge imaging process. For example, the Konica 9028, a multi-pass color printer forms a single color image for each pass. Each such pass utilizes a recharge step following development of each color image. The Panasonic FPC1 machine, like the Konica machine is a multi-pass color device. In addition to a recharge step the FPC1 machine employs an AC corona discharge device prior to recharge.

In the method of creating multi-color images using a conventional charge/expose/develop process as illustrated in the patents discussed above, voltage non-uniformity between developed (toned) and non-developed (untoned) areas on the charge retentive occurs. This non-uniformity in potential causes undesirable edge effects. The edge effect phenomena results in development of the edges of an image of one color with the marking particles of a second color.

BRIEF SUMMARY OF THE INVENTION

Briefly, in accordance with the present invention, voltage non-uniformity between toned and untoned areas on a charge retentive surface is reduced by subjecting the charge retentive surface containing toned and untoned areas to an erase step using a source of illumination prior to recharging. The toned areas represent images which are developed using charged area development (CAD) while the untoned areas represent background areas. Through use of the erase step prior to the recharge step, the voltage difference between toned and untoned areas of the charge retentive surface is reduced after recharging, for example, from 60 volts to 20 volts thereby reducing the problem of undesirable edge development. Also, depending on the charge levels involved, another benefit of the recharge corona is to flip the polarity of the CAD toner from positive to negative so that it will transfer. If this is not done the first CAD toner will not transfer. Otherwise a pre-transfer corotron is needed which is expensive and has background deposition effects. The recharge corona will only flip the charge effectively if it sprays a large amount of negative charge onto the CAD toner. This is accomplished when erase is used. If no erase is used the levels sometimes don't give enough charge to flip the polarity of the CAD toner adequately.

DETAILED DESCRIPTION OF THE PREFERRED EMBODIMENT OF THE INVENTION

This invention relates to an imaging system which is used to produce a color output in a single pass. It will be understood that it is not intended to limit the invention to the embodiment disclosed. On the contrary, it is intended to cover all alternatives, modifications and equivalents as may be included within the spirit and scope of the invention as defined by the appended claims.

Figure 1:
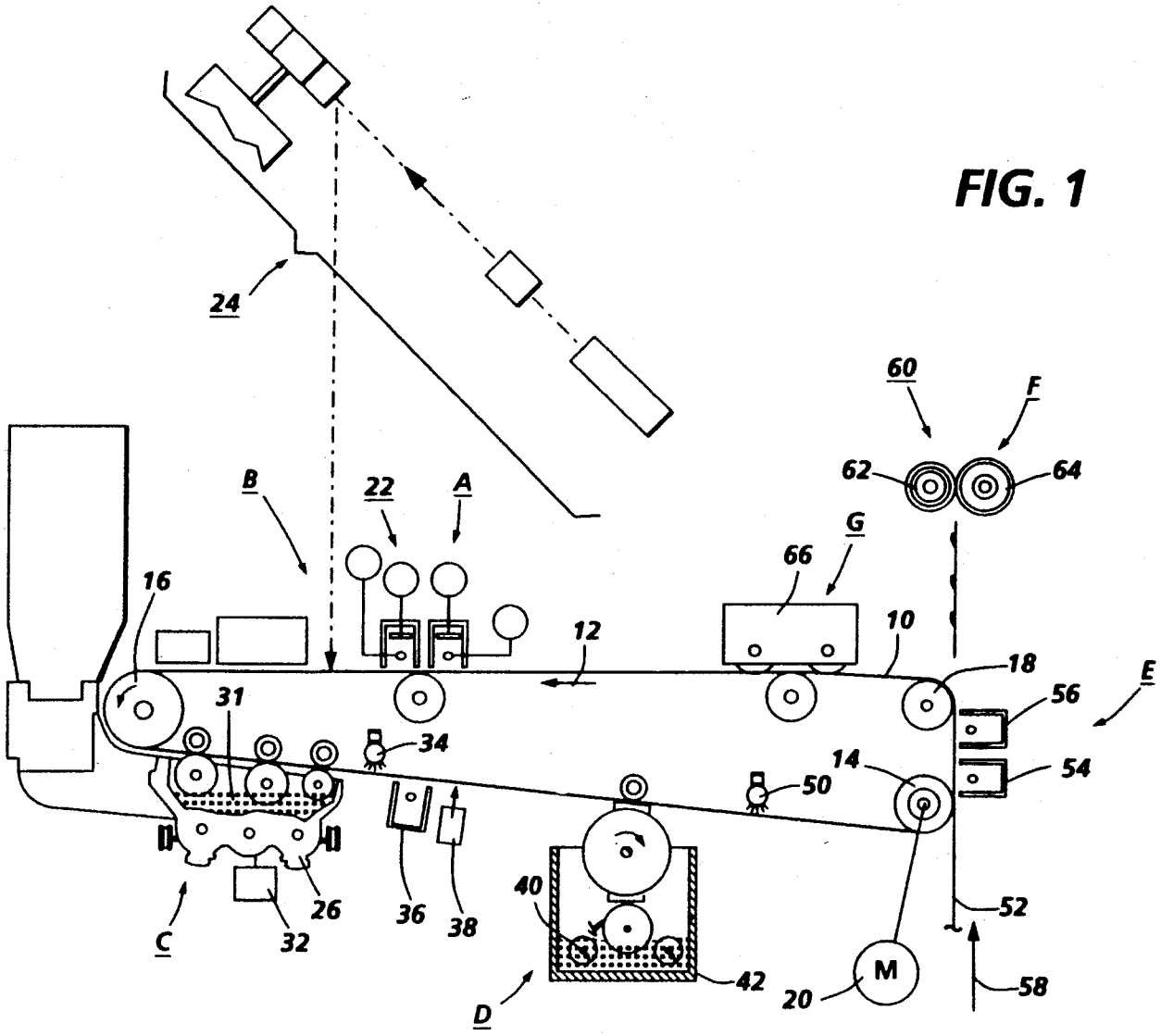
FIG. 1 is schematic illustration of an imaging apparatus incorporating the development system features of the invention.

Turning now to FIG. 1, the electrophotographic printing machine of the present invention uses a charge retentive surface in the form of an Active Matrix (AMAT) photoreceptor belt 10 supported for movement in the direction indicated by arrow 12, for advancing sequentially through the various xerographic process stations. The belt is entrained about a drive roller 14 and two tension rollers 16 and 18. The roller 14 is operatively connected to a drive motor 20 for effecting movement of the belt through the xerographic stations.

With continued reference to FIG. 1, a portion of belt 10 passes through charging station A where a corona generating device, indicated generally by the reference numeral 22, charges the photoconductive surface of belt 10 to a relative high, substantially uniform, preferably negative potential.

Next, the charged portion of photoconductive surface is advanced through an imaging station B. At exposure station B, the uniformly charged belt 10 is exposed to a laser based input and/or output scanning device 24 which causes the charge retentive surface to be discharged in accordance with the output from the scanning device. Preferably the scanning device is a two level laser Raster Output Scanner (ROS). Alternatively, the ROS could be replaced by other xerographic exposure devices.

The photoreceptor, which is initially charged to a voltage $V_0$, undergoes dark decay to a level $V_{ddp}$ equal to about $-700$ volts. When exposed at the exposure station B it is discharged to $V_{background}$ equal to about $-100$ volts. Thus after exposure, the photoreceptor contains a monopolar voltage profile of high and low voltages, the former corresponding to charged or image areas and the latter corresponding to discharged or background areas.

At a first development station C, a magnetic brush developer structure, indicated generally by the reference numeral 26 advances insulative magnetic brush (IMB) material 31 into contact with the electrostatic latent image, $V_{CAD}$. The development structure 26 comprises a plurality of magnetic brush roller members. These magnetic brush rollers presents, for example, positively charged black toner material to the charged image areas for development thereof. Appropriate developer biasing is accomplished via power supply 32. Electrical biasing is such as to effect charged area development (CAD) of the higher or more negative of the two voltage levels on the photoreceptor with the material 31.

A post CAD erase lamp 34 disposed adjacent the backside of the belt 10 serves to reduce the charge level of the photoreceptor in the toned or developed areas. Such reduction decreases the voltage difference between the toned and untoned photoreceptor areas. It also serves to decrease the toned area voltage level allowing the subsequent recharging corona device 36 to apply a sufficiently large amount of negative charge to this toned area so as to change the polarity of the previously positive toner to negative. This will facilitate the uniform transfer of all toners at the subsequent transfer station 54.

A negative recharging corona device 36 is employed for raising the voltage level of both the toned and untoned areas on the photoreceptor.

A second exposure or imaging device 38 which may comprise a laser based input and/or output structure is utilized for selectively discharging the photoreceptor subsequent to the recharging step effected by the corona discharge device 36. At this point, the photoreceptor contains toned areas at relatively high voltage levels and untoned areas at relatively low voltage, $V_{DAD}$ levels. These low voltage, untoned areas represent highlight color image areas which are developed using discharged area development (DAD). To this end a scavengeless developer system including developer material 40 comprising color toner is employed. The toner which by way of example may be read is contained in a developer housing structure 42 disposed at a second developer station D. A power supply (not shown) serves to bias this developer system to a level effective to develop the more positive or discharged image areas with negatively charged red toner particles.

Because the positive toner image from the development station C is charged by a negative recharge device 36, the composite image on the photoreceptor after development station D consists of only negative toner.

Subsequent to image development, the photoconductive surface of belt 10 is exposed to a pre-transfer erase lamp 50 disposed adjacent to the backside of the belt. This exposure will remove any residual charge on the photoreceptor and allow for effective transfer to a substrate using positive corona charging.

Subsequent to pre-transfer erase a sheet of support material 52 is moved into contact with the toner images at transfer station E. The sheet of support material is advanced to transfer station E by conventional sheet feeding apparatus, not shown. Preferably, the sheet feeding apparatus includes a feed roll contacting the uppermost sheet of a stack copy sheets. The feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station E.

Transfer station E includes a transfer dicorotron 54 which sprays positive ions onto the backside of sheet 52. This attracts the negatively charged toner powder images from the belt 10 to sheet 52. A detack dicorotron 56 is provided for facilitating stripping of the sheets from the belt 10.

After transfer, the sheet continues to move, in the direction of arrow 58, onto a conveyor (not shown) which advances the sheet to fusing station F. Fusing station F includes a fuser assembly, indicated generally by the reference numeral 60, which permanently affixes the transferred powder image to sheet 52. Preferably, fuser assembly 60 comprises a heated fuser roller 62 and a backup or pressure roller 64. Sheet 52 passes between fuser roller 62 and backup roller 64 with the toner powder image contacting fuser roller 62. In this manner, the toner powder images are permanently affixed to sheet 52 after it is allowed to cool. After fusing, a chute (not shown) guides the advancing sheets 52 to catch tray (also not shown) for subsequent removal from the printing machine by the operator.

After the sheet of support material is separated from photoconductive surface of belt 10, the residual toner particles carried by the photoconductive surface are removed therefrom. These particles are removed at cleaning station G using a cleaning brush structure contained in a housing 66.

Figure 2A:
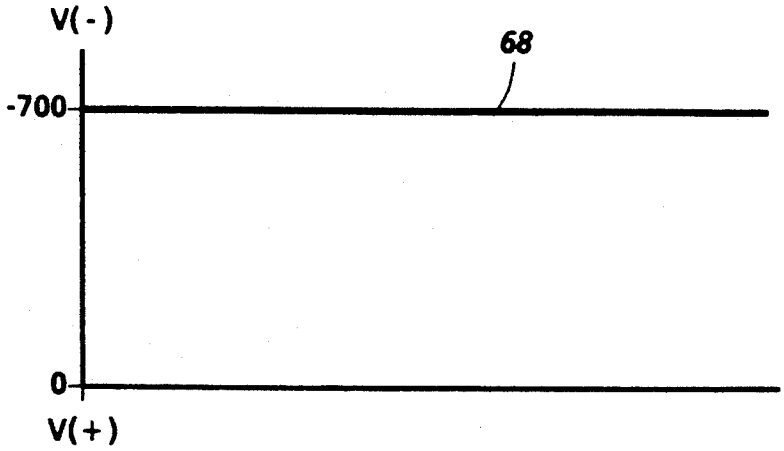
FIG. 2*a* shows the photoreceptor voltage profile after uniform charging.
Figure 2B:
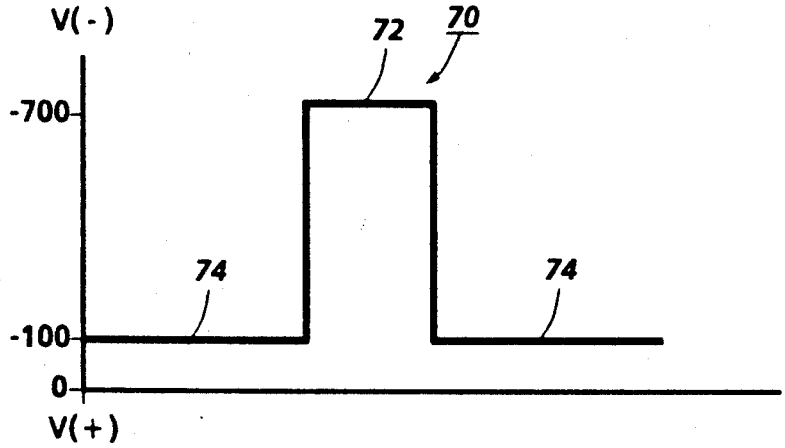
FIG. 2*b* shows the photoreceptor voltage profile after a first exposure step.

The voltage profiles on the photoreceptor 10 depicting the image forming process steps are illustrated FIGS. 2*a* through 2*g*. FIG. 2*a* illustrates the voltage profile 68 on photoreceptor belt after the belt has been uniformly charged at station A. The photoreceptor is initially charged to a voltage slightly higher than the −700 volts indicated but after dark decay the $V_{CAD}$ voltage level is −700. After a first exposure at exposure station B, the voltage profile comprises high and low voltage levels 72 and 74, respectively. The level 72 is at the original −700 volts represents the CAD image area to be developed by the black developer housing 26 while the level 74 at −100 volts represents the area discharged by the laser 24 and corresponds to the background for the first development step.

Figure 2C:
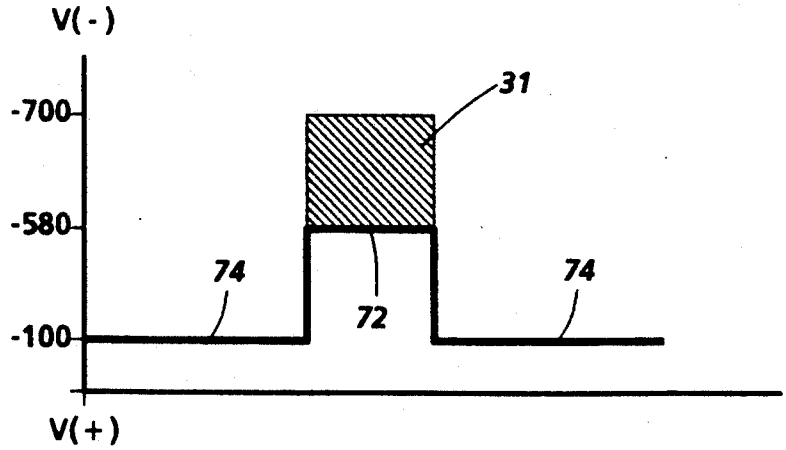
FIG. 2*c* shows the photoreceptor voltage profile after a first development step.

During the first development step, black toner adheres to the CAD image area and causes the photoreceptor in the image area to be reduced to approximately −580 volts. Thus, a voltage difference of −480 volts exists between the toned (−580 volts) and untoned (−100 volts) areas of the photoreceptor. As shown in FIG. 2*c*, the solid line 72 describes the measurable resultant voltage of the photoreceptor and the toner combination and the cross hatching 31 describes the contribution of the toner charge portion.

Figure 2D:
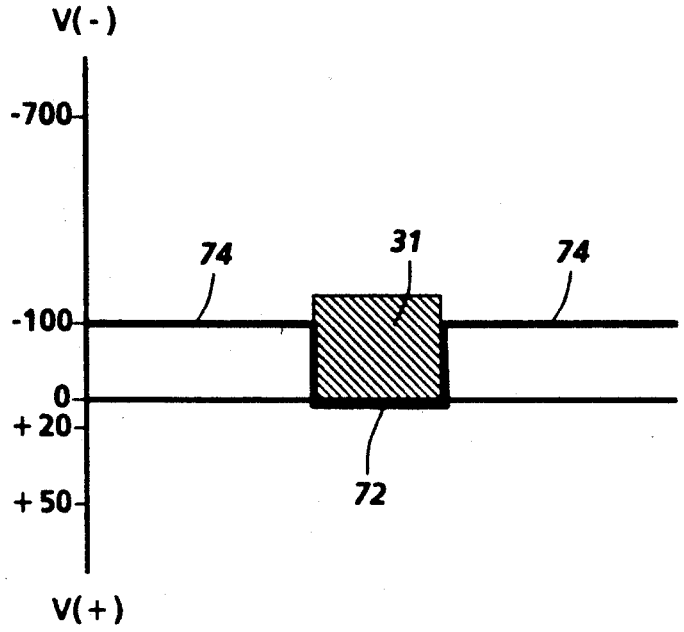
FIG. 2*d* shows the photoreceptor voltage profile after an erase step according to the present invention.
Figure 2E:
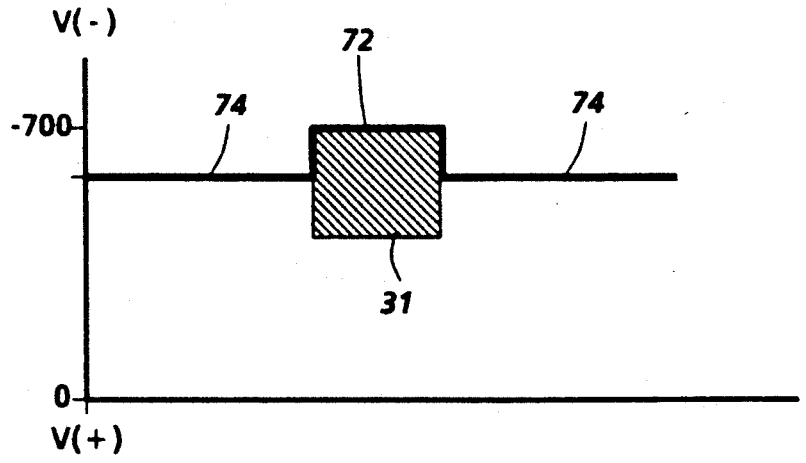
FIG. 2*e* shows the photoreceptor voltage profile after a recharging step.
Figure 2F:
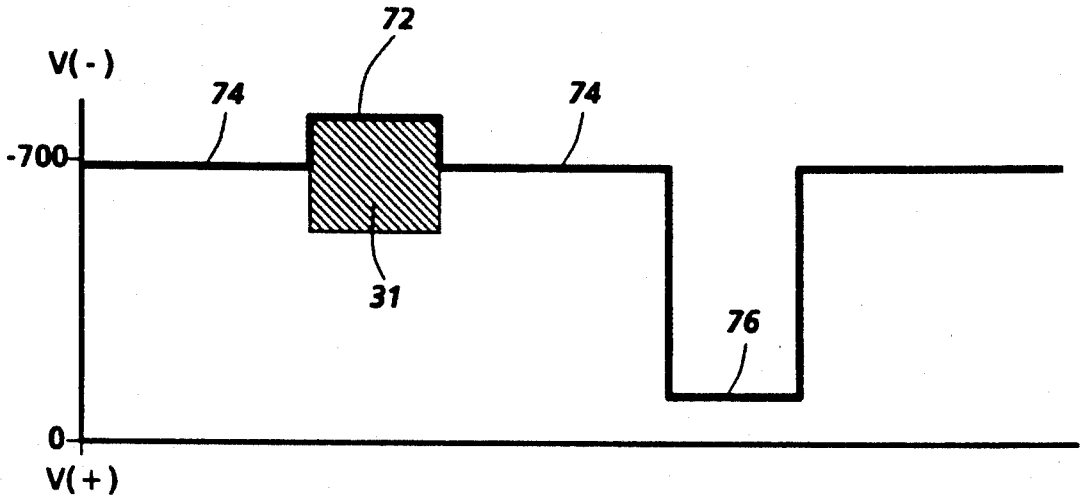
FIG. 2*f* shows the photoreceptor voltage profile after a second exposure step.

In order to minimize the adverse effects caused by such voltage differential, an erase step is performed prior to recharging of the photoreceptor pursuant to creation of a second latent electrostatic image. Thus, as shown in FIG. 2*d*, the voltage differential between the toned and untoned areas is −120 volts. When the toned areas 31 and untoned areas of the photoreceptor are subjected to the recharging step using corona charging device 36 the toned areas charge to a higher level than the untoned areas because of the increased dielectric thickness in the toned areas. By providing an erase step before recharge, the toned areas are much more positive than the untoned areas when charging occurs. This helps compensate for the increased dielectric thickness and delivers improved voltage uniformity after charging. Thus, the voltage differential is reduced to about 20 volts as illustrated in FIG. 2E. Without the erase step, the voltage differential after the recharge step would be about 60 volts or more.

Figure 2G:
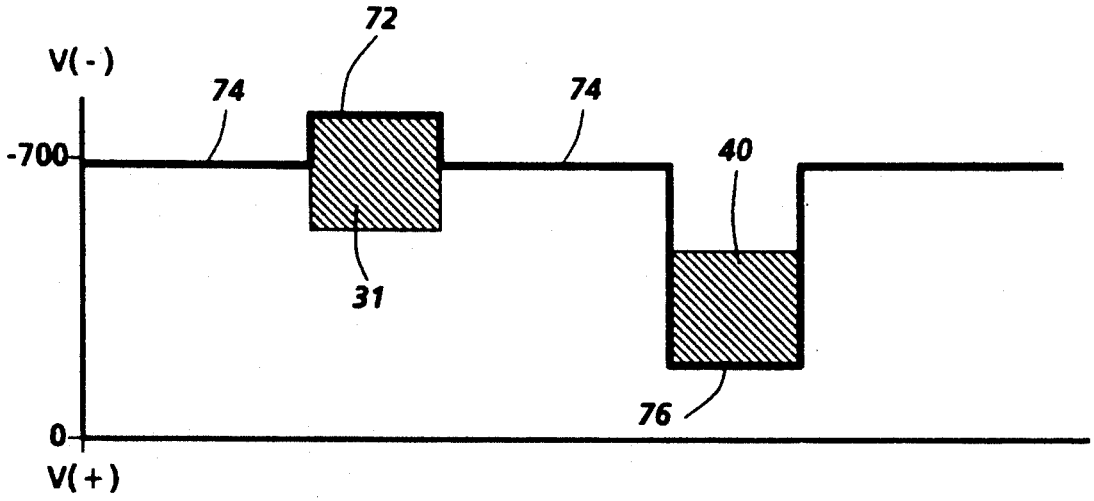
FIG. 2*g* shows the photoreceptor voltage profile after a second development step.

After the recharge step, the photoreceptor is again ready for image formation thereon. To this end, the second imaging device 38 discharges the photoreceptor to form a DAD image area 76 shown in FIG. 2F. The DAD image area is developed, as depicted in FIG. 2G, with color toner 40 using the developer housing 42.

While the foregoing description was directed to a highlight color process it will be appreciated that the invention may also be used in a process color printer as well as a multiple color highlight color machine.

What is claimed is:

1. A method for creating color images, said method comprising:

moving a charge retentive surface in a predetermined path;

uniformly charging said charge retentive surface to a predetermined voltage level;

selectively discharging said photoreceptor to delineate CAD image areas and background areas thereon;

developing said CAD image areas with toner particles of a first color which causes discharge of said CAD image areas to a voltage level intermediate said predetermined voltage level and the voltage level of said background areas;

using an erase device, conditioning said charge retentive surface to reduce the voltage differential between said CAD image areas and said background areas;

subjecting said charge retentive surface to corona discharges for increasing the voltage levels of said said CAD image areas and said background image areas whereby said voltage differential is further reduced;

forming DAD image areas on said charge retentive surface; and developing said DAD image areas with toner particles having a color different from said first color.

2. The method according to claim 1 wherein said step of conditioning effects polarity reversal of the toner on the CAD image areas.

3. A method for creating color images, said method comprising:

moving a charge retentive surface in a predetermined path;

uniformly charging said charge retentive surface to a predetermined voltage level;

selectively discharging said photoreceptor to delineate CAD image areas and background areas thereon;

developing said CAD image areas with toner particles of a first color which causes discharge of said CAD image areas to a voltage level intermediate said predetermined voltage level and the voltage level of said background areas;

conditioning said charge retentive surface to reduce the voltage differential between said CAD image areas and said background areas, said conditioning effecting polarity reversal of the toner on The CAD image areas;

subjecting said charge retentive surface to corona discharges for increasing the voltage levels of said said CAD image areas and said background image areas whereby said voltage differential is further reduced;

forming DAD image areas on said charge retentive surface; and developing said DAD image areas with toner particles having a color different from said first color.

4. The method according to claim 1 or 3 wherein said method is accomplished in a single pass.

5. Apparatus for creating color images, said apparatus comprising:

a charge retentive surface in a predetermined path;

means for uniformly charging said charge retentive surface to a predetermined voltage level;

means for selectively discharging said photoreceptor to delineate CAD image areas and background areas thereon;

means for developing said CAD image areas with toner particles of a first color which causes discharge of said CAD image areas to a voltage level intermediate said predetermined voltage level and the voltage level of said background level;

erase means for conditioning said charge retentive surface to reduce the voltage differential between said CAD image areas and said background areas;

means for subjecting said charge retentive surface to corona discharges for increasing the voltage levels of said said CAD image areas and said background image areas whereby said voltage differential is further reduced;

means for forming DAD image areas on said charge retentive surface;

means for developing said DAD image areas with toner particles having a color different from said first color; and means for moving said charge retentive surface into operative communication with each of said means.

6. Apparatus according to claim 5 wherein said means for moving comprises means for moving in a single pass.

7. Apparatus according to claim 5 wherein said means for conditioning comprises means for effecting polarity reversal of the toner on the CAD image areas.

8. Apparatus for creating color images, said apparatus comprising:

a charge retentive surface in a predetermined path;

means for uniformly charging said charge retentive surface to a predetermined voltage level;

means for selectively discharging said photoreceptor to delineate CAD image areas and background areas thereon;

means for developing said CAD image areas with toner particles of a first color which causes discharge of said CAD image areas to a voltage level intermediate said predetermined voltage level and the voltage level of said background level;

means for conditioning said charge retentive surface to reduce the voltage differential between said CAD image areas and said background areas, said conditioning means being effective to effect reverse the polarity of the toner on the CAD image areas;

means for subjecting said charge retentive surface to corona discharges for increasing the voltage levels of said said CAD image areas and said background image areas whereby said voltage differential is further reduced;

means for forming DAD image areas on said charge retentive surface;

means for developing said DAD image areas with toner particles having a color different from said first color; and means for moving said charge retentive surface into operative communication with each of said means.

* * * * *